US010163393B2

(12) United States Patent
Yang et al.

(10) Patent No.: US 10,163,393 B2
(45) Date of Patent: Dec. 25, 2018

(54) DISPLAY SUBSTRATE, DISPLAY EQUIPMENT AND REGIONAL COMPENSATION METHOD

(71) Applicant: BOE Technology Group Co., Ltd., Beijing (CN)

(72) Inventors: Shengji Yang, Beijing (CN); Xue Dong, Beijing (CN); Jing Lv, Beijing (CN); Xiaochuan Chen, Beijing (CN); Dongni Liu, Beijing (CN); Lei Wang, Beijing (CN); Li Xiao, Beijing (CN); Jie Fu, Beijing (CN); Pengcheng Lu, Beijing (CN); Han Yue, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 15/562,828

(22) PCT Filed: Mar. 29, 2017

(86) PCT No.: PCT/CN2017/078488
§ 371 (c)(1),
(2) Date: Sep. 28, 2017

(87) PCT Pub. No.: WO2018/032767
PCT Pub. Date: Feb. 22, 2018

(65) Prior Publication Data

US 2018/0286310 A1 Oct. 4, 2018

(30) Foreign Application Priority Data

Aug. 19, 2016 (CN) ..... 2016 1 0697075

(51) Int. Cl.
*G09G 5/02* (2006.01)
*G09G 3/3241* (2016.01)
(Continued)

(52) U.S. Cl.
CPC ..... *G09G 3/3241* (2013.01); *G09G 3/3266* (2013.01); *G09G 3/3283* (2013.01);
(Continued)

(58) Field of Classification Search
CPC .. G09G 3/3241; G09G 3/3283; G09G 3/3266; G09G 2320/0693;
(Continued)

(56) References Cited

U.S. PATENT DOCUMENTS

2004/0149886 A1* 8/2004 Matsueda ..... G09G 3/3233 250/208.1
2005/0093791 A1 5/2005 Lo
2006/0082528 A1 4/2006 Guo et al.

FOREIGN PATENT DOCUMENTS

CN 104217680 A 12/2014
CN 105243994 A 1/2016
(Continued)

OTHER PUBLICATIONS

Jun. 30, 2017—International Search Report and Written Opinion Appn PCT/CN2017/078488 with Eng Tran.

*Primary Examiner* — Adam R Giesy
(74) *Attorney, Agent, or Firm* — Banner & Witcoff, Ltd.

(57) ABSTRACT

A display substrate, a display equipment and a regional compensation method. The display substrate includes a pixel array, a common cathode current detection circuit, and a data signal compensation circuit. The common cathode current detection circuit is configured to detect a total current flowing through each common cathode; the data signal compensation circuit is configured to receive the pixel light emitting current of the first sub-pixel, receive the total current of the common cathode, and calculate compensation
(Continued)

data for each of the sub-pixels according to the pixel light emitting current and the total current of the common cathode.

20 Claims, 6 Drawing Sheets

(51) Int. Cl.
*G09G 3/3266* (2016.01)
*G09G 3/3283* (2016.01)

(52) U.S. Cl.
CPC ..... *G09G 2300/0809* (2013.01); *G09G 2320/0295* (2013.01); *G09G 2320/0626* (2013.01); *G09G 2320/0693* (2013.01)

(58) Field of Classification Search
CPC ... G09G 2320/0626; G09G 2320/0295; G09G 2300/0809
See application file for complete search history.

(56) References Cited

FOREIGN PATENT DOCUMENTS

| | | | |
|---|---|---|---|
| CN | 105453164 | A | 3/2016 |
| CN | 106097962 | A | 11/2016 |

* cited by examiner

DISPLAY SUBSTRATE, DISPLAY EQUIPMENT AND REGIONAL COMPENSATION METHOD

The application is a U.S. National Phase Entry of International Application No. PCT/CN2017/078488 filed on Mar. 29, 2017, designating the United States of America and claiming priority to Chinese Patent Application No. 201610697075.9, filed Aug. 19, 2016. The present application claims priority to and the benefit of the above-identified applications and the above-identified applications are incorporated by reference herein in their entirety.

TECHNICAL FIELD

Embodiments of the present disclosure relate to a display substrate, a display equipment and a regional compensation method.

BACKGROUND

In the display field, organic light emitting diode (OLED) display substrates have the characteristics such as self-illumination, high contrast, low power consumption, wide viewing angle, fast response speed, applicability to flexible panels, wide range of use temperature, simple fabrication, etc., and therefore have a broad development prospect.

Due to the above-mentioned characteristics, organic light emitting diode (OLED) display substrates may be applicable to devices having display function such as cell phones, displays, notebook computers, digital cameras and instruments and meters.

SUMMARY

An embodiment of the present disclosure provides a display substrate comprising a pixel array, a common cathode current detection circuit, and a data signal compensation circuit; the pixel array comprises a plurality of sub-pixels arranged in a matrix, each of the sub-pixels comprises an organic light emitting diode, which comprises an anode, an organic luminescent layer, and a cathode; the plurality of sub-pixels comprise first sub-pixels and second sub-pixels, each first sub-pixel further comprises a pixel current acquisition circuit configured to acquire a pixel light emitting current of the organic light emitting diode in the first sub-pixel; the pixel array is divide into a plurality of cathode common areas each comprising M compensation areas each comprising N sub-pixels, the N sub-pixels comprising one first sub-pixel, organic light emitting diodes of M×N sub-pixels in a same cathode common area share one common cathode, and M and N both being natural numbers greater than 1; the common cathode current detection circuit is configured to detect a total current flowing through each common cathode; the data signal compensation circuit is configured to receive the pixel light emitting current of the first sub-pixel in each of the M compensation areas, receive the total current of the common cathode, and calculate compensation data for each of the sub-pixels according to the pixel light emitting current of the first sub-pixel in each of the M compensation areas and the total current of the common cathode.

For example, in the display substrate of an embodiment of the present disclosure, the data signal compensation circuit is further configured to superimpose the compensation data to the display data of the sub-pixels while the display substrate is normally operating for display to obtain updated display data and transmit the updated display data to the sub-pixels.

For example, in the display substrate of an embodiment of the present disclosure, calculating of the compensation data for each of the sub-pixels according to the pixel light emitting current of each first sub-pixel in the M compensation areas and the total current of the common cathode comprises: calculating an average light emitting current of the cathode common areas according to the total current of the common cathode of the cathode common area; and superimposing the compensation data onto raw data applied to the first sub-pixels such that the pixel light emitting currents equal the average current.

For example, in the display substrate of an embodiment of the present disclosure, the memory is configured to store the compensation data for each of the sub-pixels.

For example, in the display substrate of an embodiment of the present disclosure, the plurality of the cathode common areas are of rectangle and arranged in a matrix.

For example, in the display substrate of an embodiment of the present disclosure, M=4 and N=9.

For example, in the display substrate of an embodiment of the present disclosure, the first sub-pixel further comprises a driving transistor, a light emission control transistor, a data writing transistor, an acquisition control transistor, and a storage capacitor.

For example, in the display substrate of an embodiment of the present disclosure, a first electrode of the driving transistor is electrically connected with a first node, a gate electrode of the driving transistor is electrically connected with a second node, a second electrode of the driving transistor is electrically connected with a third node; the first node is electrically connected with a power supply line to receive a power supply voltage; a first electrode of the light emission control transistor is electrically connected with the third node, a gate electrode of the light emission control transistor is electrically connected with a light emission control signal line to receive a light emission control signal, a second electrode of the light emission control transistor is electrically connected with the anode of the organic light emitting diode; a first electrode of the data writing transistor is electrically connected with a data signal line to acquire a data signal, a gate electrode of the data writing transistor is electrically connected with a scanning signal line to receive a scanning signal, a second electrode of the data writing transistor is electrically connected with the second node; a first electrode of the acquisition control transistor is electrically connected with the third node, a gate electrode of the acquisition control transistor is electrically connected with an acquisition control signal line to receive an acquisition control signal, a second electrode of the acquisition control transistor is electrically connected with the pixel current acquisition circuit; a first end of the storage capacitor is electrically connected with the first node, and a second end of the storage capacitor is electrically connected with the second node; and the cathode of the organic light emitting diode is part of the common cathode, and the common cathode is electrically connected with the common cathode current detection circuit.

For example, the display substrate of an embodiment of the present disclosure further comprises: a scan driver, a data driver, a power supply, a controller, power supply lines, light emission control signal lines, data signal lines, scanning signal lines and acquisition control signal lines, wherein, the scan driver is configured to provide light emission control signals, scanning signals and acquisition control signals to the sub-pixels via the light emission control signal lines, the scanning signal lines and the acquisition control signal lines respectively; the data driver is configured to provide data signals to the sub-pixels via the data signal lines; the power supply is configured to provide a power supply voltage to the sub-pixels via the power supply lines; the controller is configured to control the common cathode current detection circuit, the data signal compensation circuit, the pixel current acquisition circuit, the scan driver, the data driver and the power supply to allow the display substrate to work normally.

An embodiment of the present disclosure provides a display equipment comprising the display substrate of any embodiment of the present disclosure.

An embodiment of the present disclosure provides a regional compensation method for the display substrate of any embodiment of the present disclosure, comprising: applying a same raw data signal to the M×N sub-pixels in the cathode common area and driving the M×N sub-pixels to emit light; acquiring the pixel light emitting current of the organic light emitting diode OLED in each first sub-pixel in the M compensation areas in the cathode common area; acquiring a total current flowing through the common cathode in the cathode common area; calculating compensation data for each of the sub-pixels according to the pixel light emitting current of the organic light emitting diode in each first sub-pixel in the M compensation areas and the total current of the common cathode.

For example, in the regional compensation method of an embodiment of the present disclosure, in a course of displaying normally, superimposing the compensation data for each sub-pixel to display data for the sub-pixel to obtain updated display data; and transmitting the updated display data to the sub-pixel to allow the organic light emitting diode in the sub-pixel to emit light.

For example, in the regional compensation method of an embodiment of the present disclosure, calculating of the compensation data for each of the sub-pixels according to the pixel light emitting current and the total current of the common cathode comprises: dividing the total current of the common cathode by a number M×N of the sub-pixels in the cathode common areas to obtain an average light emitting current; and superimposing the compensation data onto raw data applied to the first sub-pixels in the cathode common areas such that the pixel light emitting currents equal the average current.

For example, the regional compensation method of an embodiment of the present disclosure further comprises storing the compensation data for each of the sub-pixels, wherein compensation data for N sub-pixels in each of the compensation areas of the cathode common area are same.

For example, in the regional compensation method of an embodiment of the present disclosure, the display substrate executes the regional compensation method each time when it is powered on, or the display substrate executes the regional compensation method periodically in terms of a preset interval in operation.

BRIEF DESCRIPTION OF DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAIL DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. In addition, in the embodiments of the present disclosure, the same or similar reference signs are used to refer to the same or similar components.

In OLED display substrates, the resolution is mainly limited by the level of photolithographic process and the size of fine metal mask (FFM). In case that the level of photolithographic process and the size of fine metal mask reach a certain degree, the resolution of OLED display substrates is difficult to increase further. Therefore, it is desired to find another way to address the problem of high resolution.

An OLED display substrate generally adopts an active driving mode and includes a plurality of sub-pixels arranged in an array. Each basic sub-pixel is of 2T1C pattern (namely including two transistors and one storage capacitor). In order to improve the display homogeneity of the entire panel, it is possible to adopt sub-pixels having compensation function, such as sub-pixels of 6T1C, namely including six transistors and one storage capacitor. However, as compared to basic sub-pixels of 2T1C, although an OLED display substrate with sub-pixels having compensation function can obtain better brightness homogeneity, the increase of the number of transistors in each sub-pixel results in the increase of occupied panel area, which is against to obtain high resolution OLED display substrates.

Embodiments of the present disclosure provide a display substrate, a display equipment and a regional compensation method, that acquire compensation data for each sub-pixel by acquiring the pixel light-emitting currents of the organic light emitting diodes in the first sub-pixels that are disposed periodically and the total current of the common cathode, and can realize threshold voltage compensation without using sub-pixels having compensation function. This arrangement reduces the panel area occupied by each sub-pixel and thereby facilitates increasing physical resolution of the display substrate.

Figure 1:
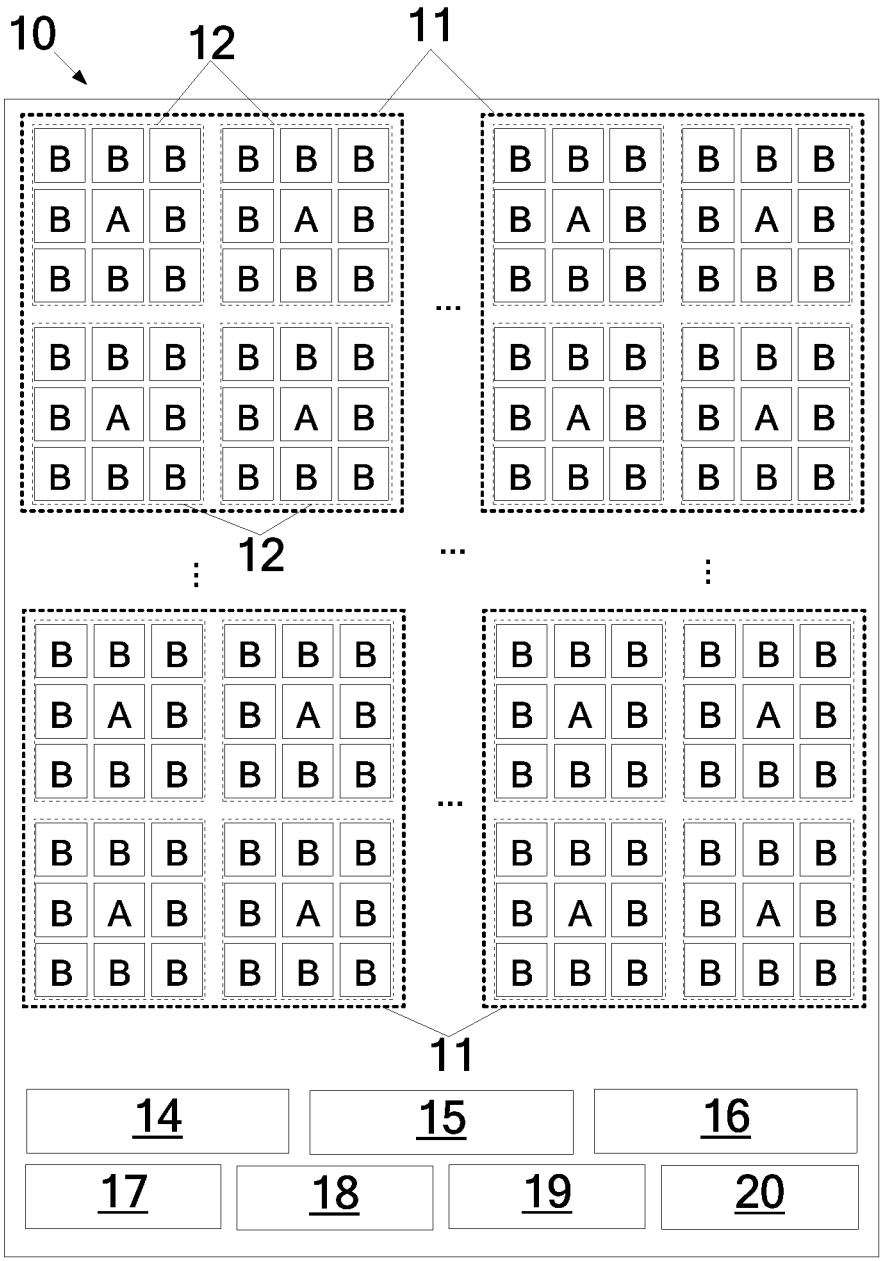
FIG. 1 is a illustrative view of a display substrate provided in an embodiment of the present disclosure.

An embodiment of the present disclosure provides a display substrate 10 as illustrated in FIG. 1, including a pixel array, a common cathode current detection circuit 14, and a data signal compensation circuit 15. The pixel array includes a plurality of sub-pixels arranged in a matrix; each sub-pixel includes an organic light emitting diode OLED (not shown in FIG. 1, referring to FIGS. 2 and 3); each organic light emitting diode OLED includes an anode, an organic light emitting layer, and a cathode. The plurality of sub-pixels include first sub-pixels A and second sub-pixels B; the first sub-pixels A each include a pixel current acquisition circuit 13 (see FIG. 2), while the second sub-pixels B do not include pixel current acquisition circuits. The pixel current acquisition circuit 13 is configured to detect the pixel light-emitting current I1 of the organic light emitting diode OLED in the first sub-pixel A.

As shown in FIG. 1, the pixel array is divide into a plurality of cathode common areas 11; each cathode common area 11 includes M compensation areas 12 (for example, M=4 in FIG. 1, namely each cathode common area 11 includes 4 compensation areas 12); each compensation area 12 includes N sub-pixels (for example, N=9 in FIG. 1, namely each compensation area 12 includes 9 sub-pixels), and N sub-pixels include one first sub-pixel A (for example, each compensation area 12 includes one first sub-pixel A and eight second sub-pixel B). Organic light emitting diodes OLEDs of the M×N sub-pixels (for example, 4×9=36 in FIG. 1) in the same cathode common area 11 share one common cathode, where M and N are both natural numbers greater than 1. The common cathode current detection circuit 14 is configured to detect (for example, acquire) the total current I2 flowing through each common cathode; the data signal compensation circuit 15 is configured to receive the pixel light emitting current I1 detected by the pixel current acquisition circuit 13, receive the total current I2 flowing through each common cathode detected by the common cathode current detection circuit 14, and calculate the compensation data Data1 for each sub-pixel according to the pixel light-emitting current I1 and the total current I2 of the common cathode.

For example, in the display substrate 10 provided in embodiment of the present disclosure, the data signal compensation circuit 15 may be further configured to add the compensation data Data1 onto the display data Data2 of the sub-pixel while the display substrate 10 is operating to display normally, to obtain updated display data Data3 and send the updated display data Data3 to sub-pixels for displaying.

For example, in the display substrate 10 provided in embodiment of the present disclosure, calculating compensation data Data1 for each sub-pixel according to the pixel light-emitting current I1 of each first sub-pixel and the total current I2 of the common cathode in the M compensation area includes: calculating an average light-emitting current I3 of the cathode common area according to the total current I2 of the common cathode of each of the cathode common area 11, for example, by dividing the total current I2 of the common cathode by the number of sub-pixels in the cathode common area 11 (M×N) to obtain an average light-emitting current I3, that is, I3=I2/(M×N); and adding the compensation data Data1 on the raw data Data0 applied to the first sub-pixel A such that the pixel light-emitting current I1 is equal to the average light-emitting current I3.

For example, the data signal compensation circuit 15 may obtain the compensation data Data1 by means of a look-up table by using the current-voltage model of the driving transistor DT and calculating the difference between the pixel light-emitting current I1 and the average light-emitting current I3, and may also obtain the compensation data Data1 by a limited number of experiments.

For example, as illustrated in FIG. 1, the display substrate 10 provided in an embodiment of the present disclosure may further include a memory 20 for storing the compensation data Data1.

For example, the memory 20 is configured to store compensation data Data1 for each sub-pixel. For example, the compensation data for sub-pixels in each compensation area 12 are identical, and the compensation data for sub-pixels in different compensation areas 12 are different.

Figure 4:
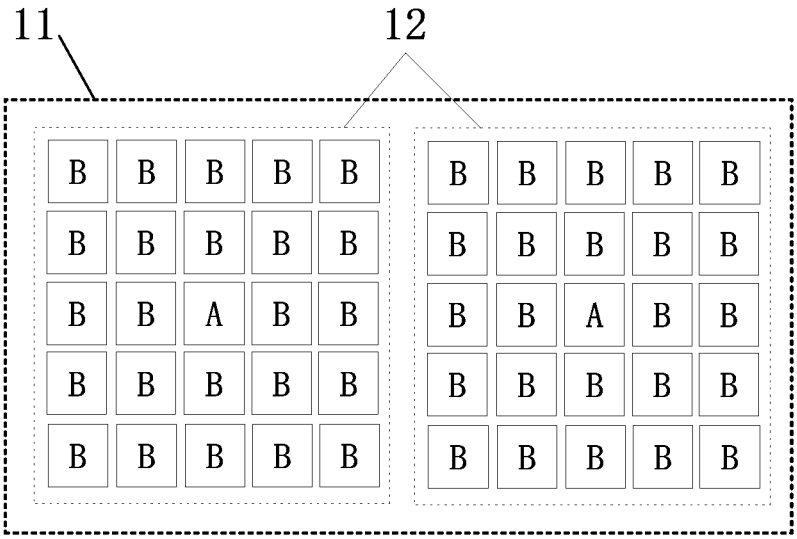
FIG. 4 is a first illustrative view of a cathode common area provided in an embodiment of the present disclosure.

For example, the display substrate 10 as illustrated in FIG. 1 is only one example in the embodiment of the present disclosure, and each cathode common area 11 in the display substrate 10 may include other number of compensation areas 12 each of which may include other number of sub-pixels. For example, as illustrated in FIG. 4, each cathode common area 11 includes 2 compensation areas 12 each of which includes 25 sub-pixels, including one first sub-pixel A and 24 second sub-pixels B surrounding the sub-pixel A.

For example, in the display substrate 10 provided in the embodiment of the present disclosure, as illustrated in FIG. 1, the plurality of cathode common areas 11 are of the shape of rectangle.

For example, in the display substrate 10 provided in the embodiment of the present disclosure, as illustrated in FIG. 1, the plurality of cathode common areas 11 are arranged in a matrix.

Figure 5:
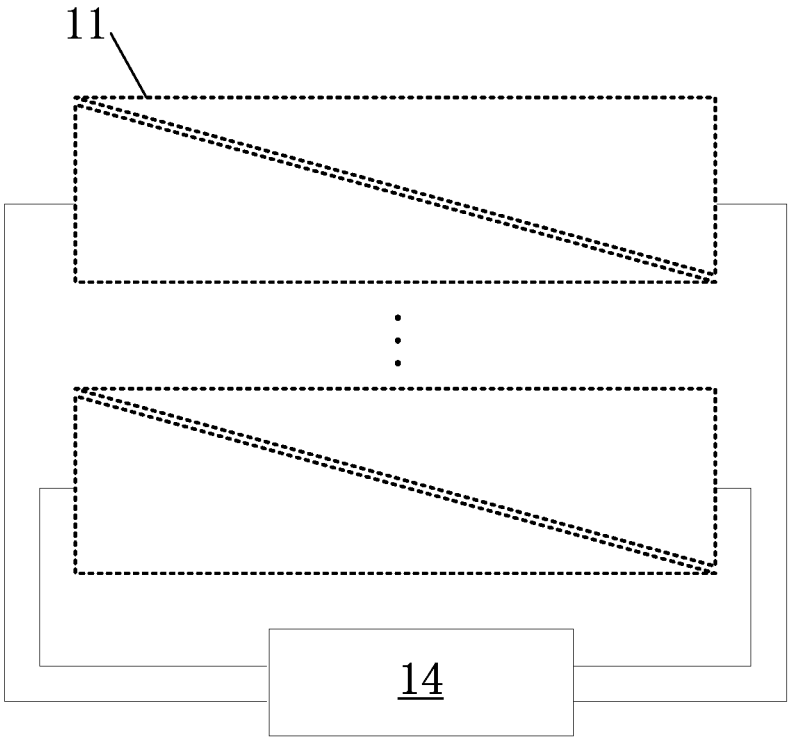
FIG. 5 is a second illustrative view of a cathode common area provided in an embodiment of the present disclosure.

For example, as illustrated in FIG. 5, the plurality of cathode common areas 11 may be of the shape of triangle and the common cathode in the plurality of cathode common areas is electrically connected with the common cathode current detection circuit 14 via one side of the triangle. For example, the triangular cathode common area 11 may facilitate routing of wires, and simplify design and production of the display substrate.

Figure 2:
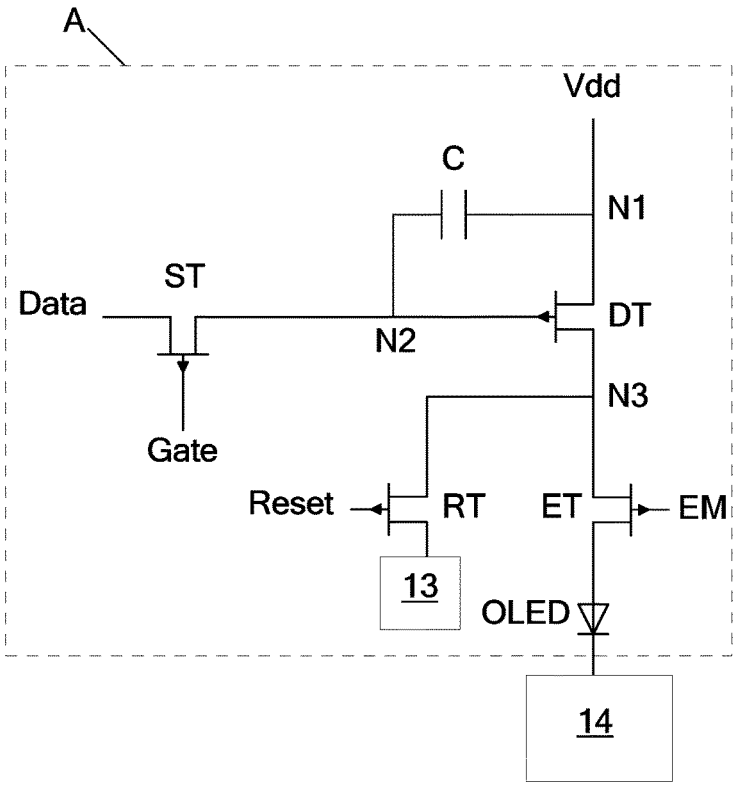
FIG. 2 is a illustrative view of a first sub-pixel provided in an embodiment of the present disclosure.

For example, in the display substrate 10 provided in an embodiment of the present disclosure, as illustrated in FIG. 2, the first sub-pixel A further includes a driving transistor DT, a light emission control transistor ET, a data writing transistor ST, an acquisition control transistor RT, and a storage capacitor C.

Figure 3:
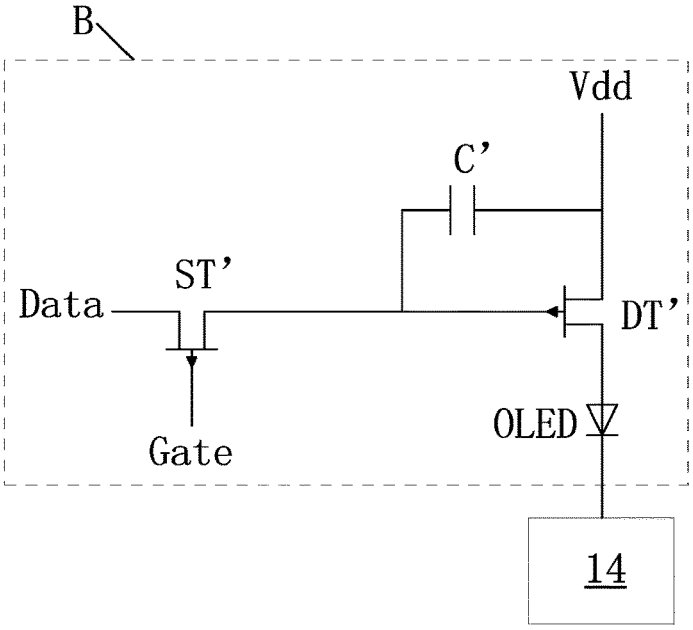
FIG. 3 is a illustrative view of a second sub-pixel provided in an embodiment of the present disclosure.

For example, FIG. 3 is a illustrative view of a second sub-pixel B provided in an embodiment of the present disclosure, and the second sub-pixel B includes an organic light emitting diode OLED, a driving transistor DT, a storage capacitor C', and a data writing transistor ST'. The connection modes for circuit components in the second sub-pixel B are similar to those in the first sub-pixel A and described specifically below.

For example, in the display substrate 10 provided in an embodiment of the present disclosure, as illustrated in FIG. 2, in the first pixel A, the first electrode of the driving transistor DT is electrically connected with the first node N1;

the gate electrode of the driving transistor DT is electrically connected with the second node N2; and the second electrode of the driving transistor DT is electrically connected with the third node N3. The first node N1 is electrically connected with the power supply line to receive a power supply voltage Vdd. The first electrode of the light emission control transistor ET is electrically connected with the third node N3; the gate electrode of the light emission control transistor ET is electrically connected with the control signal line to receive a light emission control signal EM; and the second electrode of the light emission control transistor ET is electrically connected with the anode of the organic light emitting diode OLED. The first electrode of the data writing transistor ST is electrically connected with the data signal line to acquire data signal Data (for example, the data signal Data refer to any data signal applied to the first electrode of the data writing transistor ST via the data signal line, including the raw data Data0, the display data Data2, and the updated display data Data3 etc.); the gate electrode of the data writing transistor ST is connected with the scanning signal line to receive scanning signal Gate; and the second electrode of the data writing transistor ST is electrically connected with the second node N2. The first electrode of the acquisition control transistor RT is electrically connected with the third node N3; the gate electrode of the acquisition control transistor RT is electrically connected with the acquisition control signal line to receive the acquisition control signal Reset; and the second electrode of the acquisition control transistor RT is electrically connected with the pixel current acquisition circuit 13. For example, when the acquisition control transistor RT is turned on and the light emission control transistor ET is turned off, the pixel current acquisition circuit 13 may acquire the pixel light emitting current I1 of the organic light emitting diode OLED via the acquisition control transistor RT. The first electrode of the storage capacitor C is electrically connected with the first node N1; and the second electrode of the storage capacitor C is electrically connected with the second node N2. The cathode of the organic light emitting diode OLED is the common cathode that is electrically connected with the common cathode current detection circuit 14. For example, when the OLED is emitting light, the current acquisition circuit 14 can acquire the total current I2 flowing through each common cathode.

For example, in the display substrate 10 provided in an embodiment of the present disclosure, the driving transistors DT and DT, the light emission control transistor ET, the data writing transistors ST and ST', the acquisition control transistor RT in sub-pixels A and B may all be P type transistors. For example, using the same type of transistors may unify the fabrication process flow and facilitate production.

For example, in the display substrate 10 provided in embodiments of the present disclosure, the driving transistors DT and DT, the light emission control transistor ET, the data writing transistors ST and ST', the acquisition control transistor RT in sub-pixels A and B may all be thin film transistors.

It is to be noted that the transistors adopted in the embodiments of the present disclosure may all be thin film transistors or field effect transistors or other switching devices with the same features. The source and drain electrodes of the transistors used herein may have symmetrical structures, so their source and drain electrodes may be the same in structure. In the embodiments of the present disclosure, in order to differentiate the two electrodes other than the gate electrode of a transistor, it is directly described that one of the electrodes is the first electrode and the other is the second electrode, therefore the first and second electrodes of all or part of transistors in embodiments of the present disclosure may be interchanged as required. For example, the first electrode of a transistor of the embodiments of the present disclosure may be the source electrode, and the second electrode may be the drain electrode; or the first electrode of the transistor may be the drain electrode, and the second electrode may be the source electrode. Furthermore, according to transistor characteristics, transistors may be classified into N type and P type transistors, and embodiments of the present disclosure are described with the driving transistors DT and DT', the light emission control transistor ET, the data writing transistors ST and ST', the acquisition control transistor RT all being P type transistors for example. Based on the description and teaching of implementations in the present disclosure, embodiments of the present disclosure using transistors of or combination of transistors of N and P types easily occur to those of ordinary skill in the art without any creative labor. Therefore, these implementations are also within the scope of the present disclosure.

For example, the operation process of the display substrate 10 will be described below with reference to FIGS. 6A and 6B.

For example, prior to the normal operation of the display substrate 10, the same raw data signal Data0 is applied to the N sub-pixels in one cathode common area 11.

Figure 6A:
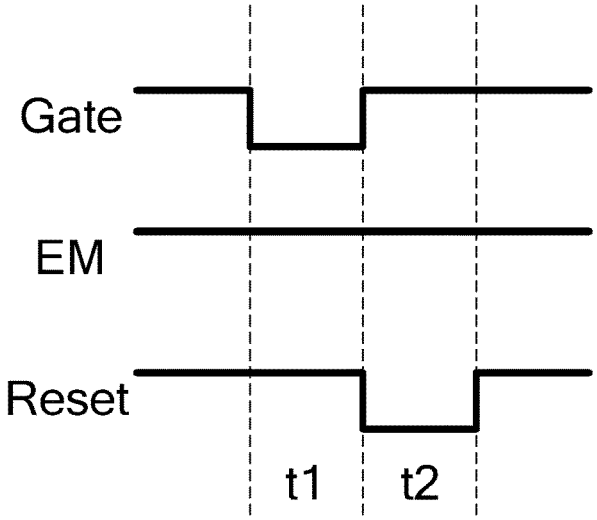
FIG. 6A is a first driving timing illustrative view of a sub-pixel provided in an embodiment of the present disclosure.

For example, as illustrated in FIG. 6A, in the data writing phase t1, the scanning signal Gate is of low level (e.g., 0V), the data writing transistor ST is in the conducting state (on-state), the raw data signal Data0 is transferred to the second node N2 (namely the gate electrode of the driving transistor DT) via the data writing transistor ST, and the storage capacitor C stores the data signal. In the pixel current acquisition phase t2, the light emission control signal EM is of high level (e.g., 5V), the light emission control transistor ET is turned off; the acquisition control signal Reset is of low level (e.g., 0V), the acquisition control transistor RT is turned on, the pixel current acquisition circuit 13 may acquire the light emitting current I1 of the organic light emitting diode OLED via the acquisition control transistor RT.

Figure 6B:
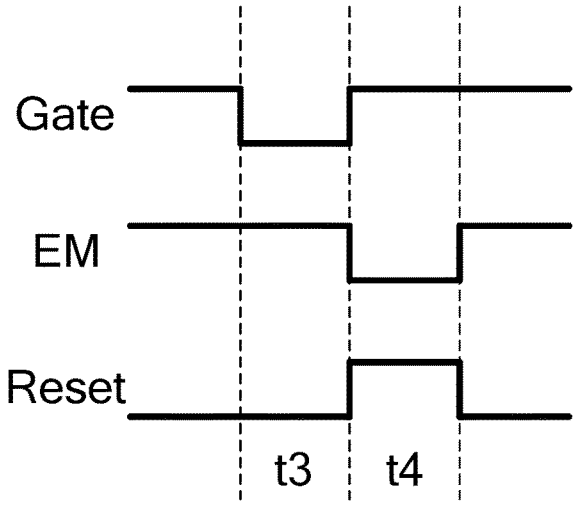
FIG. 6B is a second driving timing illustrative view of a sub-pixel provided in an embodiment of the present disclosure.

For example, as illustrated in FIG. 6B, in the data writing phase t3, the scanning signal Gate is of low level (for example, 0V), the data writing transistor ST is in the conducting state, the raw data signal Data0 is transferred to the second node N2 (namely the gate electrode of the driving transistor DT) via the data writing transistor ST, the storage capacitor C stores the data signal. In the light emitting phase t4, the light emission control signal EM is of low level, the light emission control transistor ET is turned on; the acquisition control signal Reset is of high level (e.g., 5V), the acquisition control transistor RT is turned off, the organic light emitting diode OLED emits light, and the current acquisition circuit 14 may acquire the total current I2 flowing through each common cathode.

For example, the data signal compensation circuit 15 receives the pixel light emitting current IL receives the total current I2 of the common cathode and divides the total current I2 of the common cathode by the number of pixels in the cathode common area 11 (M×N) to obtain the average light emitting current I3. A compensation data Data1 is superimposed on the raw data Data0 applied onto the first sub-pixel A such that the pixel light emitting current I1 equals the average light emitting current I3; and the compensation data Data1 is stored.

For example, when the display substrate 10 displays normally for use, the data signal compensation circuit 15 superimposes the compensation data Data1 to the display data Data2 of the sub-pixel in the compensation area to obtain updated display data Data3 and transmits the updated display data Data3 to the sub-pixels in the compensation area for displaying.

For example, the data signal compensation circuit 15 superimposes the compensation data Data1 to the display data Data2 of the sub-pixel in the compensation area via the data driver 17 to obtain updated display data Data3 and transmits the updated display data Data3 to the sub-pixels in the compensation area via the data driver 17.

For example, in the course of displaying normally, the driving timing sequence of the sub-pixels may be referenced to the driving timing sequence as illustrated in FIG. 6B, which will not be described any more herein.

It is to be noted that, because nearby areas on the display substrate have similar process characteristics, driving transistors in nearby areas also have similar threshold voltages and drift characteristics. Therefore, it is possible to use the threshold voltage of the driving transistor in the first sub-pixel to compensate for the threshold voltage of the driving transistor in the second sub-pixel in the same compensation area as this first sub-pixel. Therefore, threshold voltage compensation may be realized without using sub-pixels having compensation function. This arrangement compresses panel area occupied by each sub-pixel and thereby facilitates increasing physical resolution of the display substrate.

For example, as illustrated in FIG. 1, the display substrate 10 provided in the embodiment of the present disclosure further includes a scan driver 16, a data driver 17, a power supply 18, and a controller 19. The scan driver 16 is configured to provide a light emission control signal EM, a scanning signal Gate and an acquisition control signal Reset; the data driver 17 is configured to provide a data signal to sub-pixels; the power supply 18 is configured to provide power supply voltage Vdd to the sub-pixels; the controller 19 is configured to control the common cathode current detection circuit 14, the data signal compensation circuit 15, the pixel current acquisition circuit 13, the scan driver 16, the data driver 17 and the power supply 18 to enable the display substrate 10 to normally work.

For example, the display substrate 10 provided in an embodiment of the present disclosure may further include a power supply line, a light emission control signal line, a data signal line, a scanning signal line, and an acquisition control signal line (not shown in FIG. 1). The scan driver 16 is configured to provide a light emission control signal EM, a scanning signal Gate, and an acquisition control signal Reset to sub-pixels via the light emission control signal line, the scanning signal line and the acquisition control signal line respectively; the data driver 17 is configured to provide a data signal to sub-pixels via the data signal line; and the power supply 18 is configured to provide a power supply voltage Vdd to sub-pixels via the power supply line.

Figure 7:
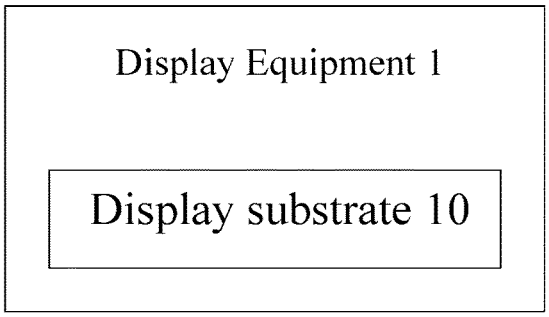
FIG. 7 is a illustrative view of a display equipment provided in an embodiment of the present disclosure.

An embodiment of the present disclosure further provides a display equipment 1 as illustrated in FIG. 7, that includes the display substrate 10 provided in any one embodiment of the present disclosure.

For example, the display equipment provided in the embodiment of the present disclosure may include any products or components with display function such as a cell phone, a slab computer, a TV set, a display, a notebook computer, a digital camera, and a navigator.

Figure 8:
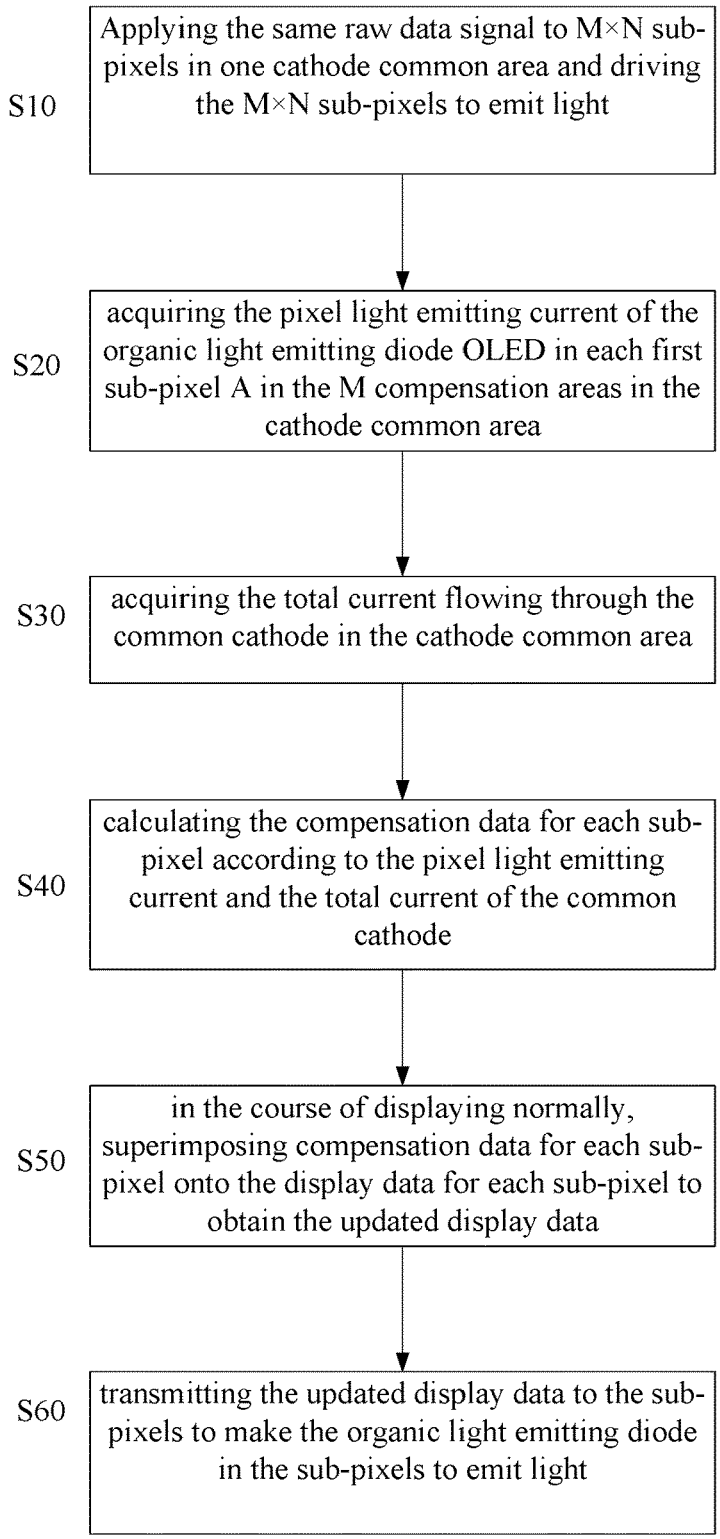
FIG. 8 is a flow chart of a regional compensation method provided in an embodiment of the present disclosure.

An embodiment of the present disclosure further provides a regional compensation method for the display substrate 10 provided in any embodiment of the present disclosure as illustrated in FIG. 8, which includes operations of:

step S10: applying the same raw data signal Data0 to M×N sub-pixels in one cathode common area 11 and driving the M×N sub-pixels to emit light;

step S20: acquiring the pixel light emitting current I1 of the organic light emitting diode OLED in each first sub-pixel A in the M compensation areas in the cathode common area 11;

step S30: acquiring the total current I2 flowing through the common cathode in the cathode common area 11; and step S40: calculating the compensation data Data1 for each sub-pixel according to the pixel light emitting current I1 and the total current I2 of the common cathode.

For example, as illustrated in FIG. 8, the regional compensation method further includes operations of:

step S50: in the course of displaying normally, superimposing compensation data Data1 for each sub-pixel onto the display data Data2 for each sub-pixel to obtain the updated display data Data3; and step S60: transmitting the updated display data Data3 to the sub-pixels to make the organic light emitting diode OLEDs in the sub-pixels to emit light.

Figure 9:
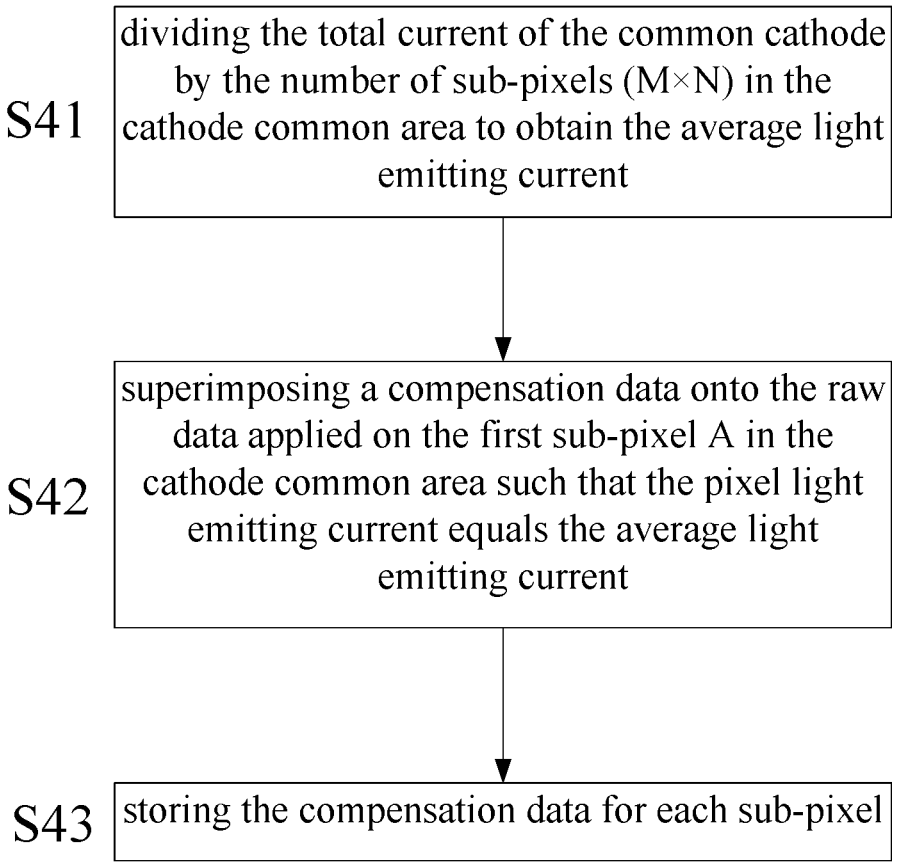
FIG. 9 is a flow chart of one example of step S40 in the regional compensation method as illustrated in FIG. 8 provided in an embodiment of the present disclosure.

For example, in the regional compensation method provided in the embodiment of the present disclosure, as illustrated in FIG. 9, calculating the compensation data Data1 for each sub-pixel according to the pixel light emitting current I1 and the total current I2 of the common cathode (namely the above-mentioned step S40) includes the following operations:

step S41: dividing the total current I2 of the common cathode by the number of sub-pixels (M×N) in the cathode common area 11 to obtain the average light emitting current I3;

step S42: superimposing a compensation data Data1 onto the raw data Data0 applied on the first sub-pixel A in the cathode common area 11 such that the pixel light emitting current I1 equals the average light emitting current I3.

For example, as illustrated in FIG. 9, calculating the compensation data Data1 for each sub-pixel according to the pixel light emitting current I1 and the total current I2 of the common cathode (namely the above-mentioned step S40) further includes:

step S43: storing the compensation data Data1 for each sub-pixel.

For example, the compensation data for N sub-pixels in each compensation area of the cathode common area are the same.

For example, the display substrate executes the regional compensation method each time when it is powered on, or the display substrate executes the regional compensation method periodically in terms of a preset interval in the operation.

With the display substrate, the display equipment and the regional compensation method provided in embodiments of the present disclosure, the compensation data for each sub-pixel is obtained by acquiring the pixel light emitting currents of organic light emitting diodes in the first sub-pixels arranged periodically and the total current of the common cathode, and the threshold voltage compensation may be realized without using sub-pixels having compensation function. This arrangement compresses panel area occupied by each sub-pixel and thereby facilitates increasing physical resolution of the display substrate.

Although detailed description has been given above to the present disclosure with reference to general description and preferred embodiment, it is apparent to those skilled in the art that some modifications or improvements may be made on the basis of the embodiments of the present disclosure. Therefore, the modifications or improvements made without departing from the spirit of the present disclosure shall all fall within the scope of protection of the present disclosure.

The application claims priority to the Chinese patent application No. 201610697075.9, filed Aug. 19, 2016, the entire disclosure of which is incorporated herein by reference as part of the present application.

What is claimed is:

1. A display substrate comprising a pixel array, a common cathode current detection circuit, and a data signal compensation circuit, wherein the pixel array comprises a plurality of sub-pixels arranged in a matrix, each of the sub-pixels comprises an organic light emitting diode, which comprises an anode, an organic luminescent layer, and a cathode, the plurality of sub-pixels comprise first sub-pixels and second sub-pixels, each first sub-pixel further comprises a pixel current acquisition circuit configured to acquire a pixel light emitting current of the organic light emitting diode in the first sub-pixel;

the pixel array is divide into a plurality of cathode common areas each comprising M compensation areas each comprising N sub-pixels, the N sub-pixels comprising one first sub-pixel, organic light emitting diodes of M×N sub-pixels in a same cathode common area share one common cathode, and M and N both being natural numbers greater than 1;

the common cathode current detection circuit is configured to detect a total current flowing through each common cathode;

the data signal compensation circuit is configured to receive the pixel light emitting current of the first sub-pixel in each of the M compensation areas, receive the total current of the common cathode, and calculate compensation data for each of the sub-pixels according to the pixel light emitting current of the first sub-pixel in each of the M compensation areas and the total current of the common cathode.

2. The display substrate of claim 1, wherein the data signal compensation circuit is further configured to superimpose the compensation data to the display data of the sub-pixels while the display substrate is normally operating for display to obtain updated display data and transmit the updated display data to the sub-pixels.

3. The display substrate of claim 2, wherein the plurality of the cathode common areas are of rectangle and arranged in a matrix.

4. The display substrate of claim 2, wherein M=4 and N=9.

5. The display substrate of claim 2, wherein the first sub-pixel further comprises a driving transistor, a light emission control transistor, a data writing transistor, an acquisition control transistor, and a storage capacitor.

6. The display substrate of claim 5, wherein a first electrode of the driving transistor is electrically connected with a first node, a gate electrode of the driving transistor is electrically connected with a second node, and a second electrode of the driving transistor is electrically connected with a third node;

the first node is electrically connected with a power supply line to receive a power supply voltage;

a first electrode of the light emission control transistor is electrically connected with the third node, a gate electrode of the light emission control transistor is electrically connected with a light emission control signal line to receive a light emission control signal, a second electrode of the light emission control transistor is electrically connected with the anode of the organic light emitting diode;

a first electrode of the data writing transistor is electrically connected with a data signal line to acquire a data signal, a gate electrode of the data writing transistor is electrically connected with a scanning signal line to receive a scanning signal, and a second electrode of the data writing transistor is electrically connected with the second node;

a first electrode of the acquisition control transistor is electrically connected with the third node, a gate electrode of the acquisition control transistor is electrically connected with an acquisition control signal line to receive an acquisition control signal, and a second electrode of the acquisition control transistor is electrically connected with the pixel current acquisition circuit;

a first end of the storage capacitor is electrically connected with the first node, and a second end of the storage capacitor is electrically connected with the second node;

the cathode of the organic light emitting diode is part of the common cathode, and the common cathode is electrically connected with the common cathode current detection circuit.

7. The display substrate of claim 2, further comprising:

a scan driver, a data driver, a power supply, a controller, power supply lines, light emission control signal lines, data signal lines, scanning signal lines and acquisition control signal lines, wherein, the scan driver is configured to provide light emission control signals, scanning signals and acquisition control signals to the sub-pixels via the light emission control signal lines, the scanning signal lines and the acquisition control signal lines respectively;

the data driver is configured to provide data signals to the sub-pixels via the data signal lines;

the power supply is configured to provide a power supply voltage to the sub-pixels via the power supply lines;

the controller is configured to control the common cathode current detection circuit, the data signal compensation circuit, the pixel current acquisition circuit, the scan driver, the data driver and the power supply to allow the display substrate to work normally.

8. The display substrate of claim 1, wherein calculating of the compensation data for each of the sub-pixels according to the pixel light emitting current of each first sub-pixel in the M compensation areas and the total current of the common cathode comprises:

calculating an average light emitting current of the cathode common areas according to the total current of the common cathode of the cathode common area; and superimposing the compensation data onto raw data applied to the first sub-pixels such that the pixel light emitting currents equal the average current.

9. The display substrate of claim 1, further comprising a memory, wherein the memory is configured to store the compensation data for each of the sub-pixels.

10. The display substrate of claim 1, wherein the plurality of the cathode common areas are of rectangle and arranged in a matrix.

11. The display substrate of claim 1, wherein M=4 and N=9.

12. The display substrate of claim 1, wherein the first sub-pixel further comprises a driving transistor, a light emission control transistor, a data writing transistor, an acquisition control transistor, and a storage capacitor.

13. The display substrate of claim 12, wherein a first electrode of the driving transistor is electrically connected with a first node, a gate electrode of the driving transistor is electrically connected with a second node, and a second electrode of the driving transistor is electrically connected with a third node;

the first node is electrically connected with a power supply line to receive a power supply voltage;

a first electrode of the light emission control transistor is electrically connected with the third node, a gate electrode of the light emission control transistor is electrically connected with a light emission control signal line to receive a light emission control signal, a second electrode of the light emission control transistor is electrically connected with the anode of the organic light emitting diode;

a first electrode of the data writing transistor is electrically connected with a data signal line to acquire a data signal, a gate electrode of the data writing transistor is electrically connected with a scanning signal line to receive a scanning signal, and a second electrode of the data writing transistor is electrically connected with the second node;

a first electrode of the acquisition control transistor is electrically connected with the third node, a gate electrode of the acquisition control transistor is electrically connected with an acquisition control signal line to receive an acquisition control signal, and a second electrode of the acquisition control transistor is electrically connected with the pixel current acquisition circuit;

a first end of the storage capacitor is electrically connected with the first node, and a second end of the storage capacitor is electrically connected with the second node;

the cathode of the organic light emitting diode is part of the common cathode, and the common cathode is electrically connected with the common cathode current detection circuit.

14. The display substrate of claim 1, further comprising:

a scan driver, a data driver, a power supply, a controller, power supply lines, light emission control signal lines, data signal lines, scanning signal lines and acquisition control signal lines, wherein, the scan driver is configured to provide light emission control signals, scanning signals and acquisition control signals to the sub-pixels via the light emission control signal lines, the scanning signal lines and the acquisition control signal lines respectively;

the data driver is configured to provide data signals to the sub-pixels via the data signal lines;

the power supply is configured to provide a power supply voltage to the sub-pixels via the power supply lines;

the controller is configured to control the common cathode current detection circuit, the data signal compensation circuit, the pixel current acquisition circuit, the scan driver, the data driver and the power supply to allow the display substrate to work normally.

15. A display equipment comprising the display substrate of claim 1.

16. A regional compensation method for the display substrate of claim 1, comprising:

applying a same raw data signal to the M×N sub-pixels in the cathode common area and driving the M×N sub-pixels to emit light;

acquiring the pixel light emitting current of the organic light emitting diode OLED in each first sub-pixel in the M compensation areas in the cathode common area;

acquiring a total current flowing through the common cathode in the cathode common area; and calculating compensation data for each of the sub-pixels according to the pixel light emitting current of the organic light emitting diode in each first sub-pixel in the M compensation areas and the total current of the common cathode.

17. The regional compensation method of claim 16, wherein, in a course of displaying normally, superimposing the compensation data for each sub-pixel to display data for the sub-pixel to obtain updated display data; and transmitting the updated display data to the sub-pixel to allow the organic light emitting diode in the sub-pixel to emit light.

18. The regional compensation method of claim 16, wherein, calculating of the compensation data for each of the sub-pixels according to the pixel light emitting current and the total current of the common cathode comprises:

dividing the total current of the common cathode by a number M×N of the sub-pixels in the cathode common areas to obtain an average light emitting current;

superimposing the compensation data onto raw data applied to the first sub-pixels in the cathode common areas such that the pixel light emitting currents equal the average current.

19. The regional compensation method of claim 16, further comprising storing the compensation data for each of the sub-pixels, wherein compensation data for N sub-pixels in each of the compensation areas of the cathode common area are same.

20. The regional compensation method of claim 16, wherein, the display substrate executes the regional compensation method each time when it is powered on, or the display substrate executes the regional compensation method periodically in terms of a preset interval in operation.

* * * * *